US009822519B2

(12) United States Patent
Hall et al.

(10) Patent No.: US 9,822,519 B2
(45) Date of Patent: Nov. 21, 2017

(54) INTELLIGENT DISPENSING TOILET BIDET SYSTEM

(71) Applicants: David R. Hall, Provo, UT (US); Dan Allen, Springville, UT (US); Ben Swenson, Lehi, UT (US); Josh Larsen, Spanish Fork, UT (US); Jared Reynolds, Pleasant Grove, UT (US)

(72) Inventors: David R. Hall, Provo, UT (US); Dan Allen, Springville, UT (US); Ben Swenson, Lehi, UT (US); Josh Larsen, Spanish Fork, UT (US); Jared Reynolds, Pleasant Grove, UT (US)

( * ) Notice: Subject to any disclaimer, the term of this patent is extended or adjusted under 35 U.S.C. 154(b) by 0 days.

(21) Appl. No.: 15/063,974

(22) Filed: Mar. 8, 2016

(65) Prior Publication Data

US 2017/0260728 A1 Sep. 14, 2017

(51) Int. Cl.

| | |
|---|---|
| ***A47K 3/20*** | (2006.01) |
| ***E03D 9/08*** | (2006.01) |
| ***E03D 1/012*** | (2006.01) |
| ***G05B 15/02*** | (2006.01) |

(52) U.S. Cl.

CPC ..... *E03D 9/08* (2013.01); *E03D 1/012* (2013.01); *G05B 15/02* (2013.01)

(58) Field of Classification Search

CPC ..... E03D 9/08
USPC ..... 4/420.5
See application file for complete search history.

(56) References Cited

U.S. PATENT DOCUMENTS

| | | | | | |
|---|---|---|---|---|---|
| 3,698,021 | A * | 10/1972 | Mack | E03D 9/037 | 4/227.3 |
| 4,918,769 | A * | 4/1990 | Gandini | A47K 11/10 | 4/363 |
| 5,027,444 | A * | 7/1991 | Tsals | E03D 5/024 | 4/226.1 |
| 5,142,712 | A * | 9/1992 | Hennessy | E03D 11/00 | 4/328 |
| 5,642,533 | A * | 7/1997 | Young | E03D 11/13 | 4/325 |
| 2005/0171709 | A1* | 8/2005 | Nortier | E03B 7/071 | 702/45 |
| 2006/0041999 | A1* | 3/2006 | Sanderson | E03D 1/00 | 4/378 |
| 2009/0013457 | A1* | 1/2009 | Mirochnik | E03D 9/033 | 4/353 |
| 2011/0113540 | A1* | 5/2011 | Plate | E03D 1/01 | 4/300 |
| 2011/0113542 | A1* | 5/2011 | Stauber | E03D 3/12 | 4/434 |
| 2014/0289950 | A1* | 10/2014 | Kitaura | E03D 5/01 | 4/432 |
| 2015/0207275 | A1* | 7/2015 | Wegelin | F16M 13/02 | 248/542 |
| 2017/0030065 | A1* | 2/2017 | Bucher | E03D 9/02 | |
| 2017/0058500 | A1* | 3/2017 | Garrels | E03D 9/038 | |

* cited by examiner

*Primary Examiner* — Lori Baker

(57) ABSTRACT

A toilet apparatus provides intelligent bidet dispensing. Dynamic dispensing according to a bidet wand position, type of substance dispensed, user preferences, user gender, and user identification is disclosed. Cleansers, surfactants, moisturizers, medicines, deodorants, and fragrances are dispensed through a bidet wand to a user and are stored reservoirs which are contained in a tank area of the toilet. In other embodiments, reporting of levels of reservoir substances is automated.

20 Claims, 10 Drawing Sheets

INTELLIGENT DISPENSING TOILET BIDET SYSTEM

BACKGROUND

Field of the Invention

This invention relates to methods and systems for cleansing users while sitting on a toilet.

Background of the Invention

Toilet users wash with soap in the shower. They also wash their hands with soap. Not surprisingly, testing shows that a bidet with a soap dispenser is much more effective in removing waste such as excrement and body fluids from the user. However, despite the considerable potential benefits, toilet bidets do not typically use soap to wash the user. The reasons are varied including where to put the soap reservoir, how to dispense the soap, appropriate soaps to use, soap dispensing and rinsing sequences and addressing issues specific to particular users or user groups, including gender-specific issues. The innovation addresses these varied problems with an intelligent soap-dispensing toilet bidet system.

SUMMARY

To address the issue of where to put the soap reservoir, the innovation introduces a reservoir in the toilet tank, which provides easy access for users to refill the reservoir. The out-of-view reservoir has a level sensor, such as capacitive sensor or light-based proximity sensor, and a system (such as a wireless connection to user's account viewable in a web browser or smart phone or tablet or toilet control tablet) for alerting the user when refill is needed and/or reporting the soap level or controlling the functionality and parameters of the toilet and bidet. Toilet and bidet inputs and outputs can be preconfigured and stored locally or remotely. The local storage may be on a personal user device or at a toilet or bidet controller. The remote storage may be cloud based storage or a network database server.

Some users are more sensitive and require a delicate soap. Accordingly, the innovation provides the option for more than one soap reservoir. The toilet has a user identification function, such as a menu to select the user, or artificial intelligence to identify the user from a pattern of behavior or biometrics. The user's preferred soap is dispensed. For instance, a pH neutral soap is recommended for sensitive individuals and a fragrance-free soap is recommended for users with allergies.

The innovation appreciates the need for a gentler soap or more dilute soap for a bidet vaginal rinse, relative to a cleansing anal rinse and provides a varied soap concentration depending on the position of a bidet wand: lower concentration or more gentle soap for the bidet and a higher concentration or stronger surfactant for the cleansing function. The concentration may be controlled by the relative rate of a soap injecting pump, such as a peristaltic pump, or a variable orifice in a flow mixing configuration such as a Venturi or valved union.

A smart toilet is provided with a bidet wand that dispenses a different soap (or no soap) depending on the wand position, for instance less or no soap when forward for the bidet function and more soap for cleansing in the rear position.

Additionally, soaps can be used in a varied sequence, a first cleansing soap, followed by a second hydrating dispense. Typically, users have to compromise with a soap between the cleansing functionality and the moisturizing functionality. A more aggressive surfactant may remove dirt or debris but strip the user skin protecting oils. A less aggressive soap may not remove dirt of debris, but provide adequate moisturizing. An alternative or optional dispense can be provided by a lotion, medicated spray, suppository-type medication, douche, or enema.

A smart toilet is provided with a sensor to detect defecation or other non-urination events and dispenses soap accordingly. In an example, the soap is used when defecation is detected, but not for urination.

A soap dispensing system is provided with an optimal length of tubing after the junction of the soap and water sources for mixing the soap with water to achieve a desired level of foaming and/or dilution prior to the spray nozzle, typically 5-15 cm. A shorter 2-10 cm length of tubing may be used for a rapid transition between soap dispensing and rinsing.

The soap dispensing bidet system is provided with a user select feature, which can be a tablet-based menu, a button, or mobile application, or an AI-based or categorization algorithm-determined estimation of user identity. The system may sense the user's preferred soap, or gender-specific soap.

The system may be constructed from a non-porcelain material, such as fiberglass reinforced plastic, aka "engineered stone", a molded plastic, a thermoplastic or other non-porcelain or non-ceramic material which has properties advantageous for precise manufacturing and connecting various components. In an example, a toilet is provided with a compression molded (e.g. sheet molded compound or SMC; or fiber reinforced plastic FRP) tank in which is one or more liquid reservoirs for things like soaps, lotions, and medications. The tank is provided with a through connection for hoses from the liquid reservoir to the bidet, which may be in the toilet seat or the toilet bowl.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which:

FIG. 4 also shows a detailed view of a bidet wand head in accordance with an embodiment of the invention.

DETAILED DESCRIPTION

It will be readily understood that the components of the present invention, as generally described and illustrated in the Figures herein, may be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings, wherein like parts are designated by like numerals throughout.

Figure 1:
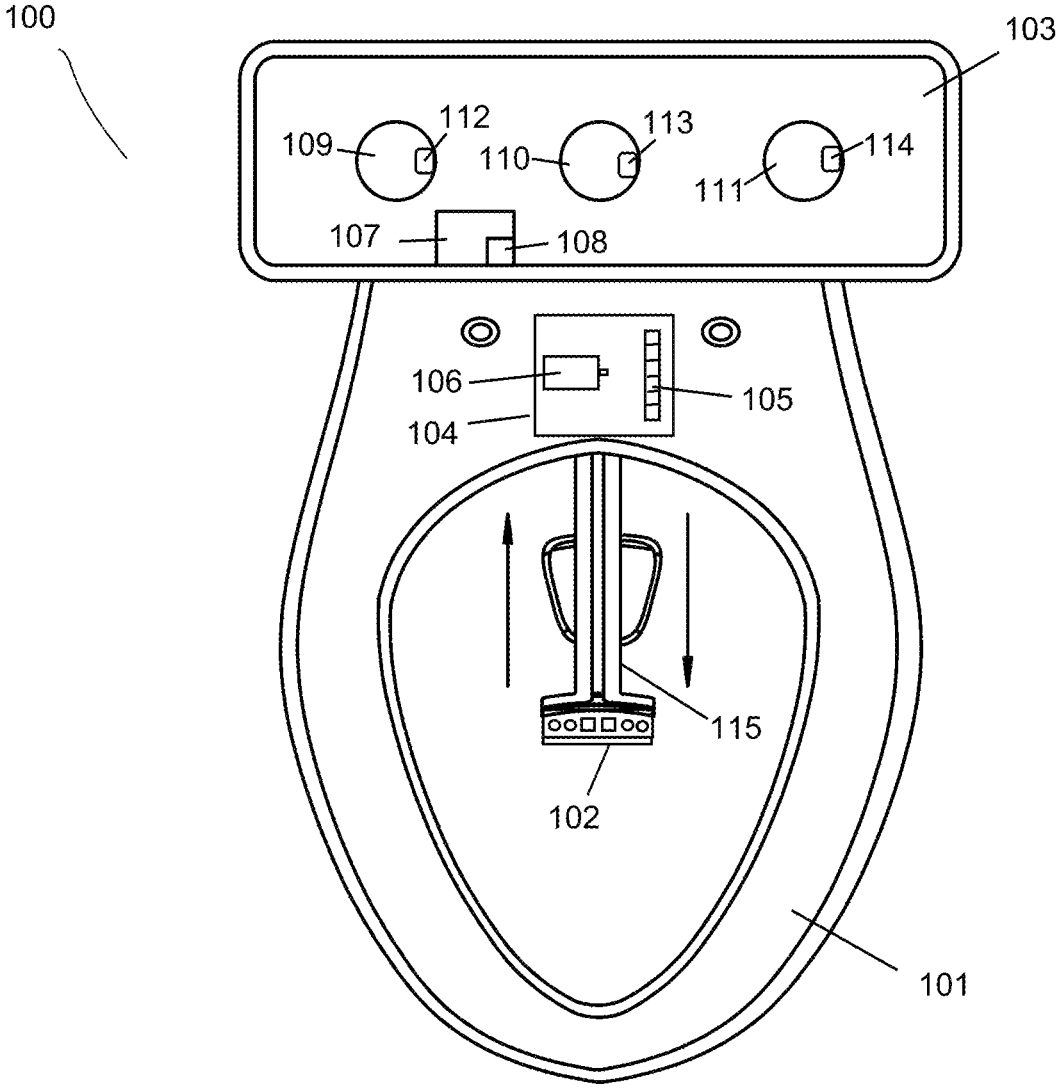
FIG. 1 is a top view of an embodiment of a toilet apparatus in accordance with an embodiment of the invention.
Figure 2:
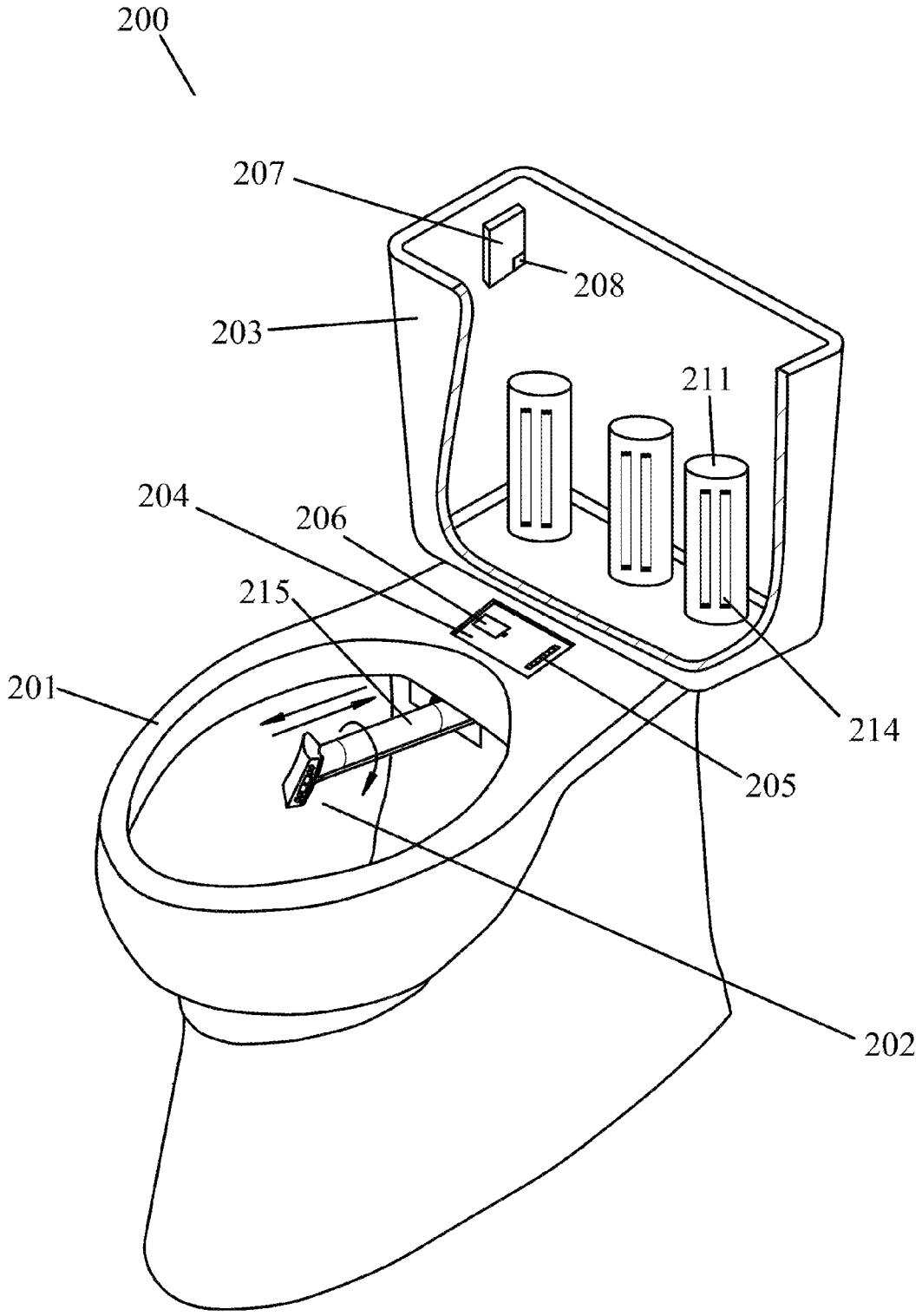
FIG. 2 is an isometric view of an embodiment of a toilet apparatus in accordance with an embodiment of the invention.

Referring to FIGS. 1 and 2, a toilet apparatus 100 and 200 in accordance with the invention is illustrated. FIGS. 1 and 2, for convenience, illustrate a toilet apparatus 100 and 200 without a toilet seat or a toilet tank lid. In FIGS. 1 and 2, toilet tanks 103 and 203 are shown having reservoirs 109, 110, 111, and 211 inside of toilet tank 103 and 203. The reservoirs may be in any configuration and position such as stacked on each other. The number of reservoirs may be chosen based on types of substances used and may be scaled accordingly. The reservoirs may be pressurized with a propellant. The reservoirs may be disposable or refillable. The reservoirs may be partially filled with a propellant in order to transfer one or more substances from the reservoir to a bidet wand head. Propellants may include compressed gas or liquefied gas which expands when exposed to a lower pressure environment. Each of the reservoirs contain one or more level sensors 112, 113, 114, and 214. The level sensors provide an input to controllers 107 and 207 and may be any type of sensor used to detect a level of a substance such as optical sensors, proximity sensors, capacitive sensors, inductive sensors, resistive sensors, weight sensors, etc. The sensors may detect a position of the level of the substance in each reservoir with respect to a full and an empty state. The reservoirs 109, 110, 111, and 211 can be refilled as needed. The substance in the reservoirs may include one or more of liquids, powders, gels, granules, foams, cleansers, surfactants, moisturizers, medicines, deodorants, or fragrance. Controllers 107 and 207 are shown in a toilet tank but may be located in any location on or in the toilet apparatus including under water. Controllers 107 and 207 are used to detect a level of the substances in the reservoirs 109, 110, 111, and 211. Controllers 107 and 207 each have a communications port 108 and 208 for providing bidirectional communication and networking between toilets, network database servers, user devices, remote devices, and wireless sensors connected to the toilets. Bidet wands 102 and 202 are shown in an extended position. Each bidet wand includes a head section 102 and 202 and a ridged body section 115 and 215. In FIG. 2, we specifically see a rotatable bidet wand head. The wand head can rotate to any angle from 0-360 degrees. This rotatable head can be used for inspection and treatment of a user's bottom side and inspection and treatment of a toilet bowl. The rotatable spray ports 416 (shown in FIG. 4) are able to spray and treat areas of a user or areas of a toilet bowl with additive substances such as liquids, powders, gels, granules, foams, cleansers, surfactants, moisturizers, deodorants, or fragrance. Foam may be formed by a mixture of air, water, and additive substances mixing together at the bidet wand head or at another location of the bidet wand dispensing system. Foam may be sprayed onto a user's bottom or a toilet bowl. Each rigid body section 115 and 215 may serve as a conduit for one or more substances, hoses, wires or fiber optic lines. Multiple conduits may house different substances, wires or fiber optic lines. Head section 102 may employ multiple spray heads, electrical sensors, optical sensors, optical transmitter/receiver pairs and cameras. The spray heads may rotate according to a user command or programmed machine command. The spray ports 416 may be in any location and configuration on head section 102 of the bidet wand. The spray heads may rotate or spray directionally by the force of pressure, for example an oscillatory spray nozzle or rotating spray nozzle may be used. The spray heads may spray different substances through each head or a mixture of substances. Optical detection of surface particles, feces, bacteria, or bile through visible, UV, or IR fluorescence or optical inspection may be used to determine a cleanliness of a user or of a toilet bowl. Visual inspection may also be employed through a live video feed to a user's phone, computer or handheld control. Upon detection of an unclean area an appropriate washing may be applied based on the condition and findings. The spray ports may be automatically or manually directed towards a detected area which is not clean. The spray ports are described in greater detail with reference to FIG. 4. Bidet wand positioning system 104 and 204 contains a movement device 106 and 206 for moving the bidet head to different positions based on user identification, user preferences, gender, detection of a type of cleaning needed, a calendar date, an automatic profile configuration, manual selection, automated cleaning routines, or factory programmed settings. The movement device may include motors, linear actuators, screw drives, solenoids, belt drives, direct drives, pinion gears, or manual actuation, etc. The movement device may include a tilting member and actuator for tilting the bidet wand and head. The movement device may also include a rotational device for rotating the bidet head and/or wand. Bidet wand positioning system 104 and 204 contains position sensors 105 and 205 for determining and tracking a position of bidet wand heads 102 and 202. The positioning and tracking system may incorporate vision system feedback for control and identification of regions of interest on a user or in a toilet bowl. Regions of interest may include body features of a user where cleaning would normally occur, areas of detected surface particles, feces, bacteria, or bile. Additional regions of interest may include areas of a toilet bowl in which surface particles, feces, bacteria, bile, or urine is detected.

The toilet devices 100 and 200 illustrated in FIGS. 1 and 2 may address a multitude of different shortcomings of the prior art, such as how to dispense the soap, appropriate soaps to use, soap dispensing and rinsing sequences and addressing issues specific to particular users or user groups, including gender-specific issues. Optimizing dispensing of soaps and rinsing based on gender specific positioning and sequencing of substances leads to effective removal of waste such as excrement and body fluids from the user. Additionally, automated cleaning and inspection of a toilet bowl can be achieved.

Figure 3:
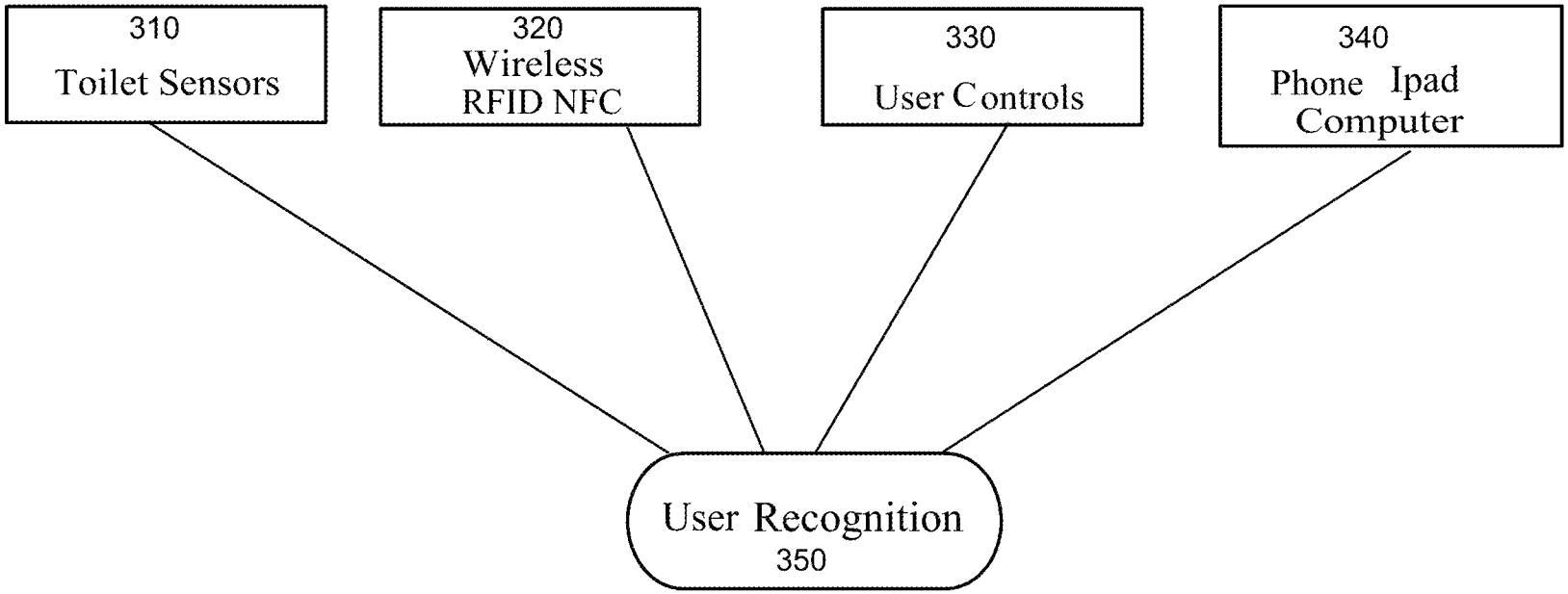
FIG. 3 is a diagram of user recognition by a toilet apparatus in accordance with an embodiment of the invention.

FIG. 3 provides a diagram of possible ways that a user is recognized by the toilet apparatus in accordance with the invention. Toilet sensors 310 may be located on or in a toilet seat (not shown), or be mounted or attached or inside of any part of the toilet apparatus. The sensor may comprise optical sensors, impedance sensors, EKG sensors, weight sensors, temperature sensors, pressure sensors, acoustic sensors, audio sensors, microphones, wireless transceivers, cameras, proximity sensors, IR sensors, biometric sensors, fingerprint sensors, retinal and/or iris scan sensors, etc. These sensors may recognize a user approaching a toilet and activate a toilet controller input sequence for further recognizing a user. For example, a user may approach a toilet and a proximity sensor awakens a Bluetooth transceiver or a wireless access point which then may activate a software application on a user device. In another example, a microphone may pick up noise and activate a toilet controller and query a user wirelessly or visually at a user bidet wand controller. In another example, a user sits on an instrumented toilet seat and a user's preconfigured user profile and settings are recognized based on weight, pulse, temperature, bio-impedance, IP address, mobile device ID, phone number, email address, user login, mac address, and/or EKG readings. Preconfigured user settings are then loaded or downloaded, from an online database, into program memory of the bidet controller. Any combination of the toilet sensors may be used to recognize a user and user settings. A user may have an online or local account for storing bidet settings and for recording trending data related to the toilet sensors. Wireless sensors 320 may comprise a smartcard, RFID chip or tag, or NFC transaction device. For example, a user may wish to register a smartcard such as a credit card or rewards card with an online or local toilet bidet account. Then the user approaches a toilet apparatus of the current invention in a public restroom his preconfigured settings can be loaded by interrogating his smartcard. This interrogation may happen automatically as he is taking off his pants and his pants come into close proximity to the toilet apparatus or he may swipe his wallet close to a surface of the toilet or restroom. A barcode may also be read to load preconfigured settings of a user. For example, a user has a saved barcode on his phone and an optical scanner reads the barcode and then loads settings stored in the barcode or remotely obtains preconfigured setting from an online database. User controls 330 refer to a user wand control device shown in FIG. 8. A user may be recognized by a finger print scanner and the users preconfigured settings may be loaded. The user control wand of FIG. 8 may also include a built in camera for optical recognition of a user. The user control wand may also include a built-in microphone for voice recognition and command and control functions of the toilet device. Additional features and function of the user control wand will be described in relation to FIG. 8.

Figure 4:
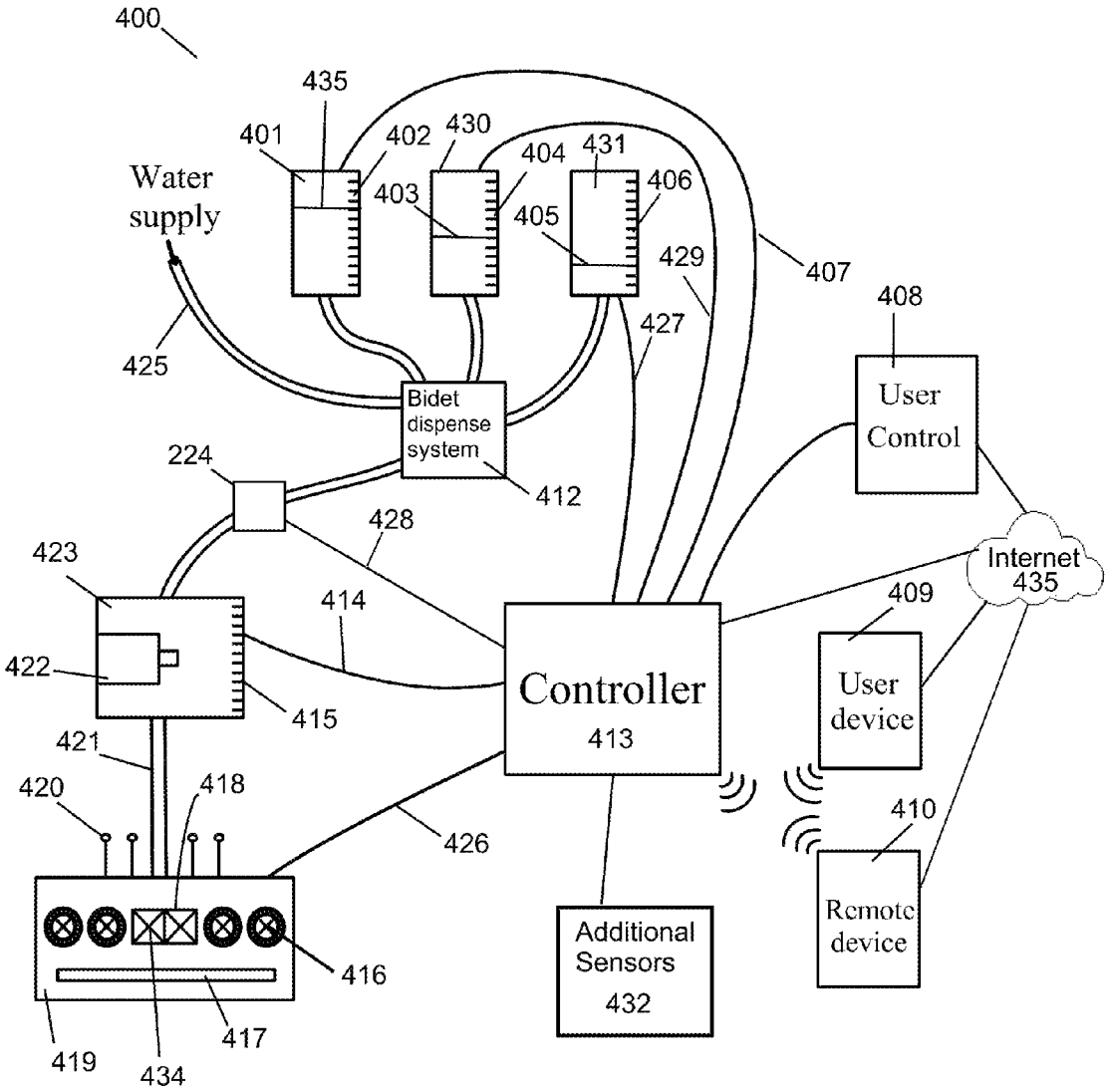
FIG. 4 is a schematic diagram of a toilet apparatus in accordance with an embodiment of the invention.

FIG. 4 shows an overall schematic diagram 400 of the toilet apparatus in accordance with an embodiment of the current invention. Controller 413 is capable of processing programmed data functions in relation to inputs and outputs of the controller. Controller inputs and outputs may be analog, digital, optical, wireless, Bluetooth, USB, Ethernet, video, audio or acoustic. The controller may be connected to a network of toilets and may be used as an Internet access point for users and for other toilets. A network of toilets may report maintenance actions in a way that optimizes repair and refill of reservoirs 401, 430 and 431 such that multiple toilets may be refilled or repaired during a single maintenance visit to a facility with numerous toilets. Reporting of maintenance actions may be automatically reported to a remote device 410. Reporting may also include an estimated empty reservoir date based on readings and trending readings of a level sensor 402, 404, or 406. Bidet dispensing system 412 dispenses water supply 425 and reservoir substances 435, 403 and 405 in accordance with user preferences or settings. System 412 may contain solenoids, check valves, one-way valves, pressure regulators, orifices, capillary tubes, thermostatic metering devices, Venturi valves, valved unions, injection pumps, constant volume pumps, constant pressure pumps, mems actuators, etc., as is well known in the art of liquid metering and control. System 412 may also include pressure sensors, temperature sensors, heaters and flow sensors. Sensor module 224 may also be incorporated into System 412. Sensor module 224 contains output sensors for providing feedback to Controller 413. These sensors may include pressure sensors, temperature sensors, and flow sensors. Bidet positioning system 423 positions and tracks bidet head 419. Positioning system 423 contains movement device 422 for moving the bidet head 419 to different positions based on user identification, user preferences, gender, detection of a type of cleaning needed, a calendar date, an automatic profile configuration, or a manual selection. The movement device may comprise motors, linear actuators, screw drives, solenoids, belt drives, direct drives, pinion gears, or manual actuation, etc. Bidet positioning system 423 contains position sensors 415 for determining and tracking a position of bidet wand head 419. Position sensors 415 may include Hall sensors, encoders, optical flags, magnetic sensors, magnetic strip sensors, optical graduations, step counting, etc. System 423 may also contain one or more heaters for heating a substance being dispensed. The position information is used as feedback control for movement device 422 by way of controller 413. Controller 413 controls movement device 422 based on position sensors 415 and user settings. User device 409 may be a phone or table or computer which connects to controller 413. User device 409 may be used to setup an account for the user containing stored bidet user settings. A user account and settings may be stored in the user device 409, controller 413, remote device 410 and/or network database server 435. A user device 409, remote device 410 or user control 408 may be use as an optical inspection device to determine cleanliness of a user or for clinical purposes. Images and or video may be stored and uploaded to network database server 435. A physician may be given access to user information or real time data for clinical purposes. Remote device 410 may be a maintenance computer or a physician's computer. A physician may be able to check on a healing surgery, stitches, hemorrhoids, bed sores, etc., and apply medications remotely or prescribe a specific type of bidet flush or treatment. Bidet head 419 may include an optical inspection system 434 and 418. The inspection system may include cameras and light sources. The inspection system may include a fiber optic bundle of transmit receive pairs or a single monofilament transmit and a single monofilament receive pair. Optical lenses may be used which allow for focusing and detection of features of a user's bottom side. A lens cleaning routine may be used to spray off the lens with water, cleaner or compressed air or heated compressed air. Air or water jets may be formed in a fixed or moveable position on the bidet head for cleaning the bidet head inspection optics, camera, or bidet head spray ports. FIG. 4 shows four bidet head spray ports 416. The spray ports 416 may be each individually rotatable so as to direct a spray pattern toward a desired area on a user or on a bowl. Controller 413 by way of control line 426 is able to electro-magnetically move each spray port 416. Control line 426 may also carry power, optical signals, and other sensors signals from sensors 420. Sensors 420 may include temperature sensors, pressure sensors, flow sensors, etc. Optical inspection system 434 or 418 can be used as visual feedback as to direct the spray direction of each port. A bidet head self-cleaning routine may be used automatically inspect and clean the bidet head at the end of a bidet use. A user self-cleaning routing may be used to automatically inspect and clean a user. A bowl self-cleaning routine may be used to automatically inspect and clean the toilet bowel. The bidet positioning system 423 may be used to rotate the bidet head between 0 and 360 degrees (shown in FIG. 2) and point towards the inside of the toilet bowl 201 for bowel inspection and cleaning purposes. Additional sensors 432 may be located at different locations other than on the bidet head on toilet apparatus 100 or 200. Sensors 432 may include gas sensors, LEDs, photodiodes, CCD sensors, motion sensors, microphones, speakers, etc. Controller 413 reads reservoir levels 435, 403, and 405 using level sensors 402, 404, and 406 by way of connections 427, 429, and 407. The controller 413 or a program running on network database server 435 may be able to predict a date of an empty state of reservoirs 401, 430, and 431 based on current, historic and/or trending level sensor readings.

Figure 5:
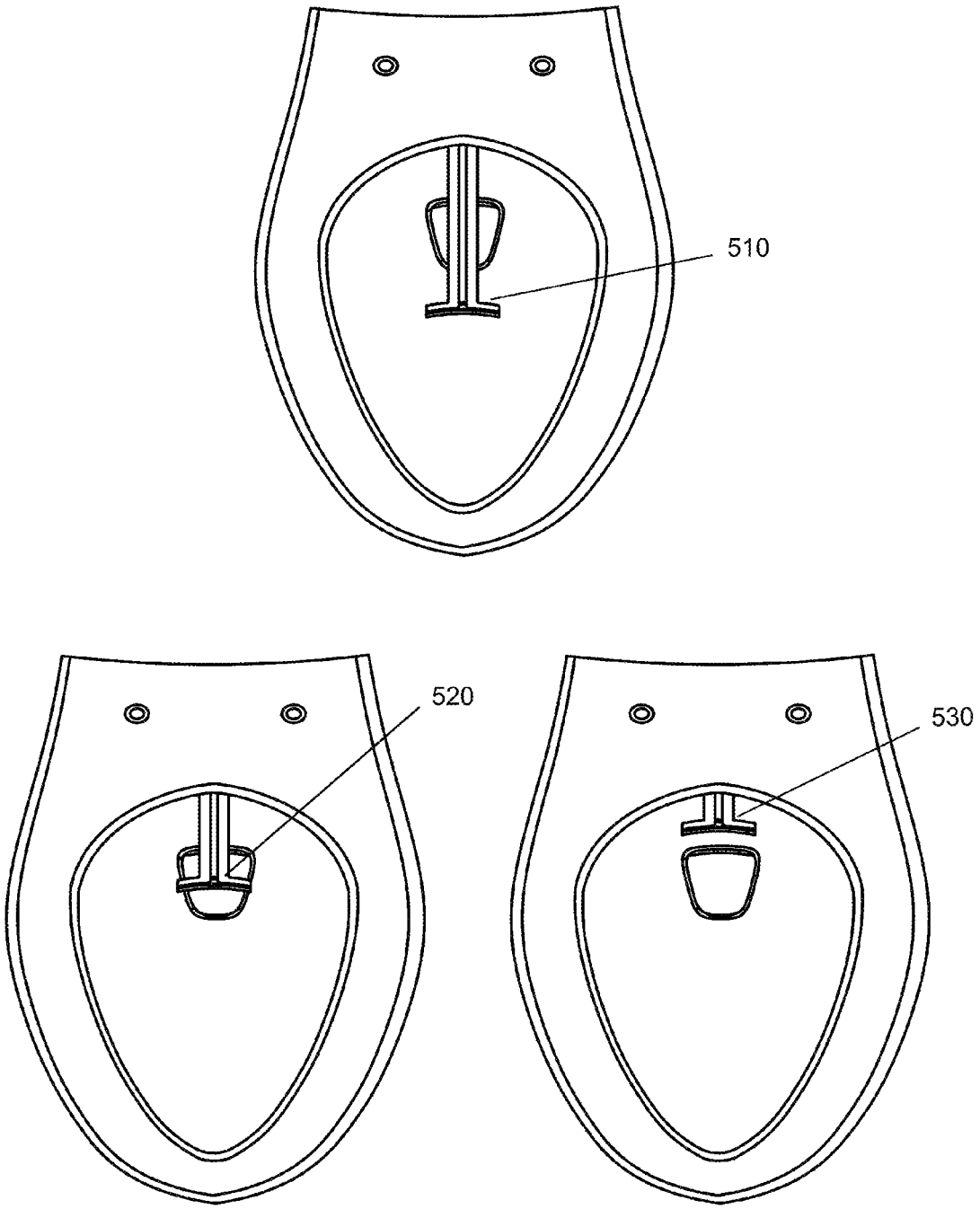
FIG. 5 is a top view of three instances of the same toilet apparatus showing different positions of a bidet wand in accordance with an embodiment of the invention.

FIG. 5 illustrates a bidet head in positions 510, 520 and 530. Position 510 is an extended position which may be useful for washing a front portion of a user and may have specific application for cleaning a female front portion. A front portion cleaning may have different spray pressures, temperature, and additive substance requirements than that of other positions. For example, a female user may desire to only rinse with water. Another female user may desire to rinse with a specific temperature of rinse water. Another female user may desire to rinse with an additive deodorizing substance at a specific temperature. Position 520 may be useful for cleaning a middle portion of a user. Position 530 may be useful for cleaning a back portion of a user. Users can define a position, temperature, pressure, and additive substance associated with each position. Users can also define a customized cleaning routine such as rinse, wash, rinse, rinse. Users can also use real time video feedback to determine when to stop a bidet washing or rinsing. Users can also use an automated cleaning cycle based on a visual inspection system. Users can also select a time dependent preprogrammed cycle based on stored user preferences, gender default settings, or manual operation. Gender default settings may be used by users for standard cleaning based on factory programmed settings. Factory programmed settings may include a light wash, a normal wash, or a heavy wash. Factory programmed settings may also include a light rinse only, a normal rinse, or a heavy rinse. Factory programmed settings may also include combinations of rinse and wash and applications of additive substances. Additive substance may include liquids, powders, gels, granules, foams, cleansers, surfactants, moisturizers, medicines, or deodorants.

Figure 6:
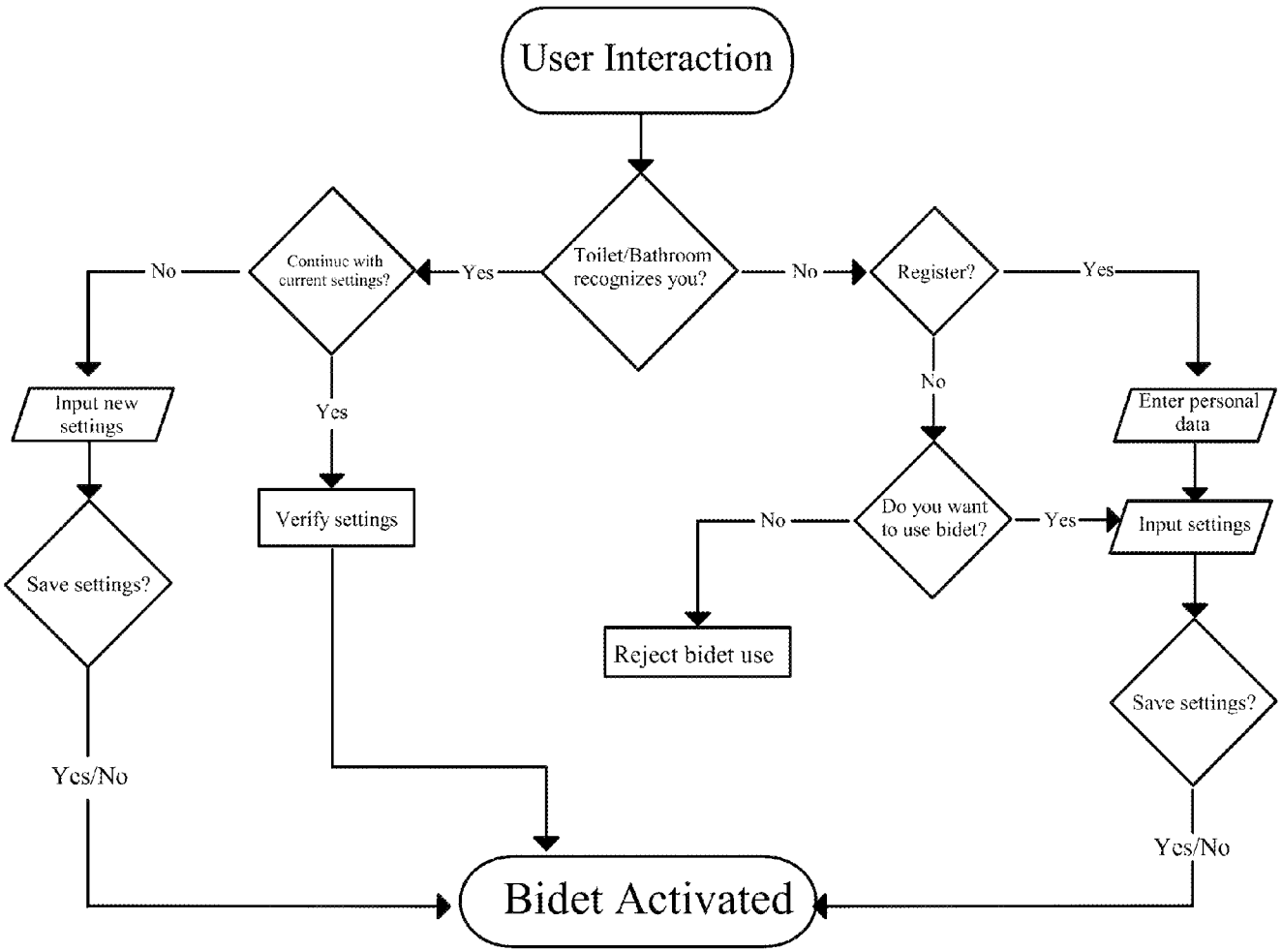
FIG. 6 is flow diagram of user interaction with a toilet apparatus in accordance with an embodiment of the invention.
Figure 7:
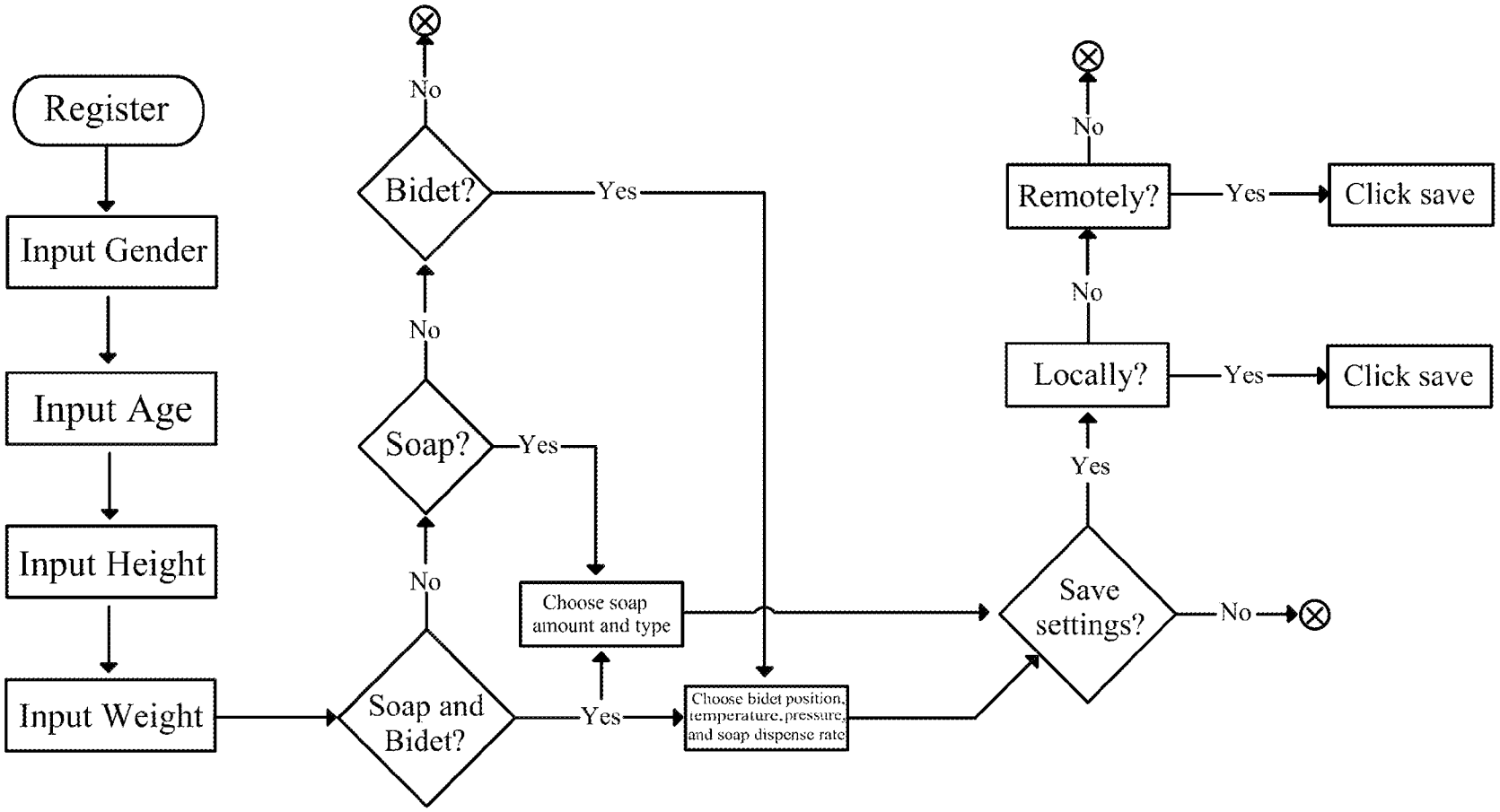
FIG. 7 is flow diagram of user interaction with a toilet apparatus in accordance with an embodiment of the invention.

FIGS. 6 and 7 show possible methods of activating a bidet cleansing in accordance with an embodiment of the invention. A user may register and save his or her settings or manually use the bidet cleaning functions. The settings may be save remotely in a remote computer or in an Internet database server such as a cloud database.

Figure 8:
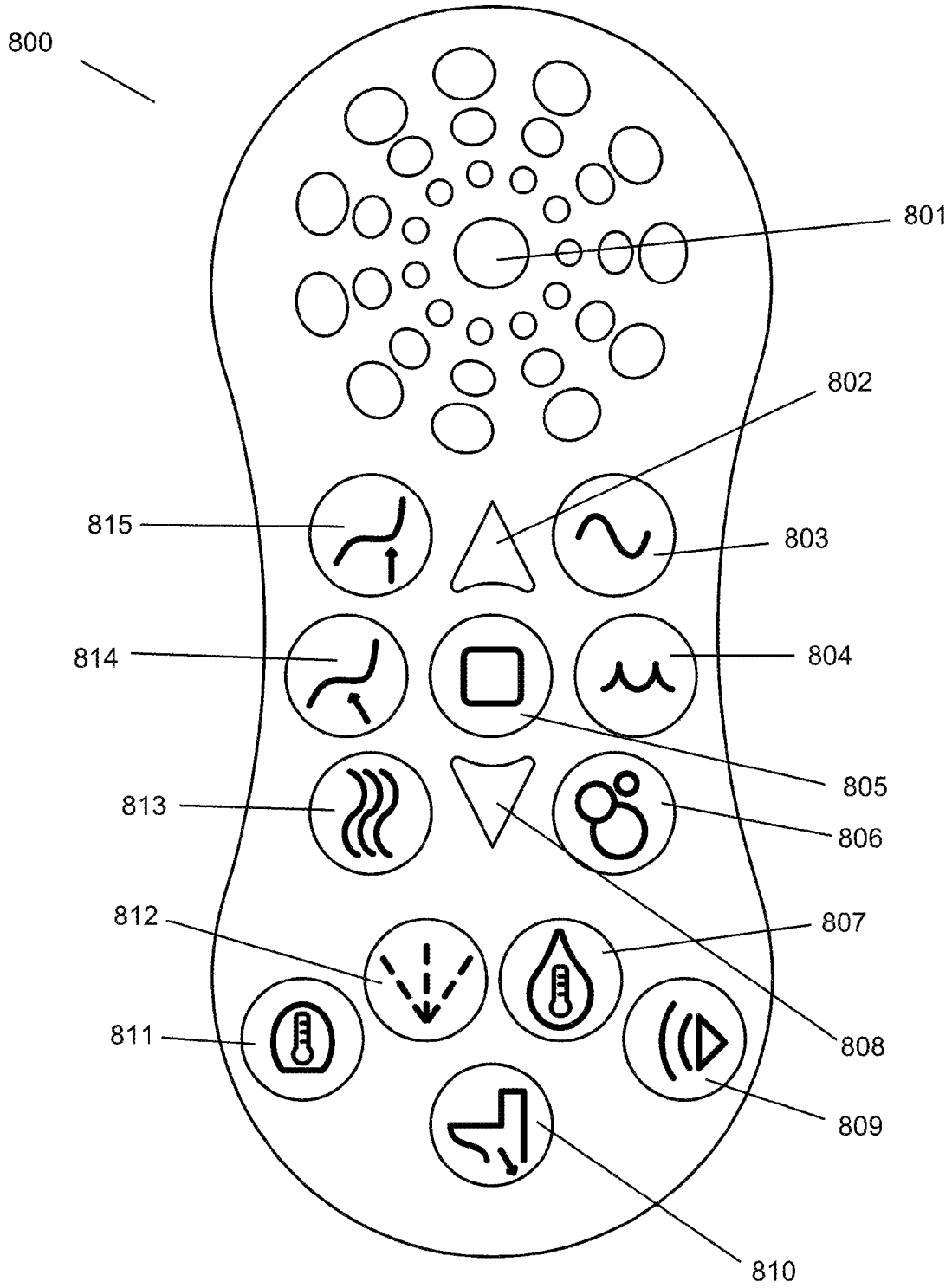
FIG. 8 is a top view of a user bidet wand control in accordance with an embodiment of the invention.

In FIG. 8, a bidet user controller 800 is depicted with multiple control functions. Finger print scanner 801 is used to obtain a finger print from a user and log a history of a user's preferred settings. The history may be used to automatically program a user's preferred settings into remote database so the user can view and associate his or her trending use settings with a user personal device. The user personal device can be used when a bidet controller 800 is not available or is lost. When a user is recognized the finger print area may change colors indicating that a user has been recognized. A user may use the bidet without using the finger print reader. Button 815 provides a spray in a rear area of a user. Button 803 varies the presser of the spray according to a sine wave. Button 802 moves the bidet head forward and 808 moves the bidet head backwards. Button 805 is a stop all function. Button 804 provides a pulsating pressure. Button 814 provides a front spray. Button 813 provides a drying function. Button 806 provides a soap dispense function. Button 812 provides a wide spray function. Button 807 provides a water temperature function. Button 811 provides a toilet seat heat function. Button 810 provides a courtesy flush function. Button 809 provides multimedia functionality.

Figure 9:
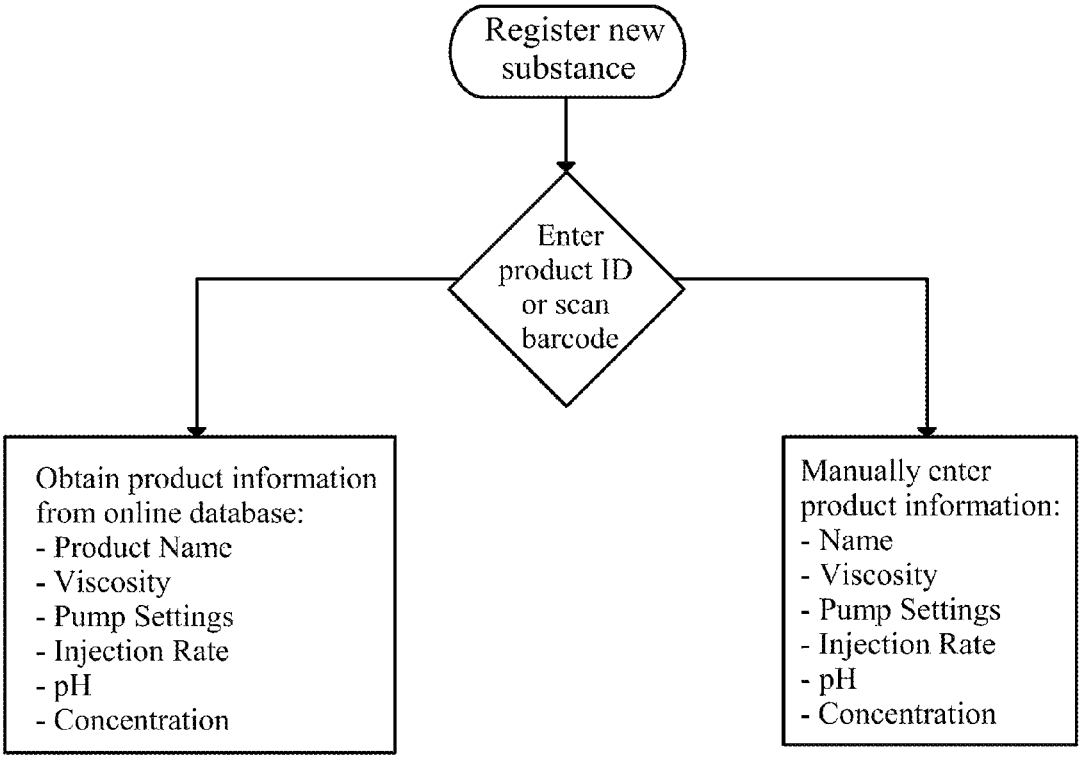
FIG. 9 is a flow diagram of new substance registration in accordance with an embodiment of the invention.

FIG. 9 shows a possible method of registering new substances into a specific reservoir 401, 430 or 431. A product identification code or barcode may be entered or scanned into a user device which is connected to a toilet controller 413 and/or a network database server 435 through a user account. The information may be automatically populated based on retrieval of the information from an Internet database. When the product is low an automatic distribution/logistics system may automatically order and ship a replacement product to a user address associated with a user account. The user may specify in their account if they want automatic shipping and reporting of levels of substances in the reservoirs. A user may be a toilet maintenance worker, an owner of the toilet, or a guest user of the toilet. For instance, if a user is using a public restroom and it is out of fragrance, the user can login to the bidet system and send an instant request to the toilet owner or maintenance worker requesting immediate delivery of the fragrance substance to their toilet stall and the user could refill the reservoir.

Figure 10:
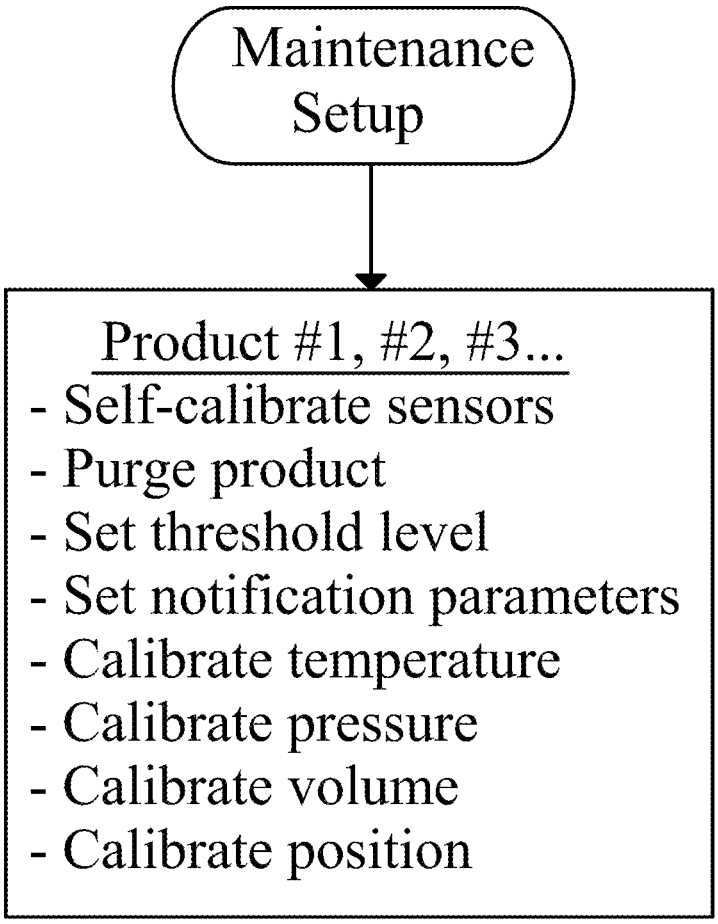
FIG. 10 is a flow diagram of maintenance setup options in accordance with the invention.

FIG. 10 shows possible maintenance functions associated with a toilet apparatus of an embodiment of the current invention. Maintenance setup functions may be part of a user's account. Maintenance setup functions may be accessible by a user device or through a remote computer or by accessing a network database server. All of the sensors of toilet apparatus 100 may be calibrated and/or may be auto-calibrated through a maintenance function program. A product may be able to be purged. Threshold levels for failure notifications may be set, for example a motor current, solenoid current, over-temperature conditions, positioning error deviation thresholds, reservoir level prediction parameters, low reservoir thresholds, date and time settings, types of product in each reservoir, injection rates of substance injection, etc. A notification email address and/or text message number may be entered. Fluid dispensing parameters may also be calibrated and setup in the maintenance setup program.

The toilet apparatus and methods disclosed herein may be embodied in other specific forms without departing from their spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A toilet apparatus comprising:

a toilet bowl for obtaining body excrements from a user of the toilet a water storage tank for storing water for flushing the toilet bowel;

at least one or more reservoirs disposed in the water storage tank;

at least one or more level sensors for generating signals associated with at least one or more substances in the one or more reservoirs;

a controller for receiving an input associated with the user and also associated with the one or more substances in the one or more reservoirs; and a bidet wand for dispensing the one or more substances to the user based on the input, wherein the bidet wand comprises an optical inspection system, and wherein the optical inspection system comprises a camera.

2. The apparatus of claim 1, wherein the one or more substances comprise at least one or more of: liquids, powders, gels, granules, foams, cleansers, surfactants, moisturizers, medicines, deodorants, or fragrance.

3. The apparatus of claim 1, further comprising generating a status notification.

4. The apparatus of claim 3, wherein the status notification is communicated by one or more of: an email, a text message, a visual indicator, or an audio indicator.

5. The apparatus of claim 1, wherein the input comprises user settings including at least one of: a selection of the one or more substances, a mixture amount of the one or more substances, a concentration amount of the one or more substances, a duration of application of the one or more substances, a volume dispense amount of the one or more substances, a dispensing pH of the one or more substances, or a pressure dispense amount of the one or more substances.

6. The apparatus of claim 4, wherein the status notification comprises a health status of the toilet apparatus.

7. The apparatus of claim 6, wherein the health status includes at least one of: an operational state, a failure status, a number of operations, a time in operation, or a maintenance request.

8. The apparatus of claim 4, wherein the status notification comprises a level of the one or more substances in the at least one or more reservoirs.

9. The apparatus of claim 5, further comprising a user account which is able to interact with and modify the user settings.

10. The apparatus of claim 9, wherein the user account is accessible through at least one of: a wireless connection, a wired connection, an optical connection, or a remote network connection.

11. A method comprising:

providing a toilet bowl for obtaining body excrements from a user of the toilet providing a water storage tank for storing water for flushing the toilet bowel;

providing at least one or more reservoirs disposed in the water storage tank, the one or more reservoirs comprising one or more substances;

receiving an input generated by an optical inspection system disposed on a bidet wand, the optical inspection system comprising a camera;

and dispensing the one or more substances to the user based on the input through the bidet wand.

12. The method of claim 11, wherein the one or more substances comprise at least one or more of: liquids, powders, gels, granules, foams, cleansers, surfactants, moisturizers, medicines, deodorants, or fragrance.

13. The method of claim 11, further comprising generating a status notification.

14. The method of claim 13, wherein the status notification is communicated by one or more of: an email, a text message, a visual indicator, or an audio indicator.

15. The method of claim 11, wherein the input comprises user settings including at least one of: a selection of the one or more substances, a mixture amount of the one or more substances, a concentration amount of the one or more substances, a duration of application of the one or more substances, a volume dispense amount of the one or more substances, a dispensing pH of the one or more substances, or a pressure dispense amount of the one or more substances.

16. The method of claim 14, wherein the status notification comprises a health status of the toilet apparatus.

17. The method of claim 16, wherein the health status includes at least one of: an operational state, a failure status, a number of operations, a time in operation, or a maintenance request.

18. The method of claim 14, wherein the status notification comprises a level of the one or more substances in the at least one or more reservoirs.

19. The method of claim 11, further comprising a user account which can interact with and modify the user settings.

20. The method of claim 19, wherein the user account is accessible through at least one of: a wireless connection, a wired connection, an optical connection, or a remote network connection.

* * * * *